US010605450B2

(12) United States Patent
Krowech et al.

(10) Patent No.: US 10,605,450 B2
(45) Date of Patent: Mar. 31, 2020

(54) TUBE SPREADING DEVICE AND BOILER CLEANING SYSTEM

(71) Applicant: HRST, Inc., Eden Prairie, MN (US)

(72) Inventors: Robert James Krowech, Eden Prairie, MN (US); Scott Daniel Olson, Crystal, MN (US)

(73) Assignee: HRST, INC., Eden Prairie, MN (US)

( * ) Notice: Subject to any disclaimer, the term of this patent is extended or adjusted under 35 U.S.C. 154(b) by 622 days.

(21) Appl. No.: 14/921,417

(22) Filed: Oct. 23, 2015

(65) Prior Publication Data

US 2016/0116158 A1 Apr. 28, 2016

Related U.S. Application Data

(60) Provisional application No. 62/068,171, filed on Oct. 24, 2014.

(51) Int. Cl.

| | |
|---|---|
| ***F22B 37/54*** | (2006.01) |
| ***F28G 1/16*** | (2006.01) |
| ***F28G 15/00*** | (2006.01) |
| *B25B 9/02* | (2006.01) |

(52) U.S. Cl.

CPC ..... *F22B 37/54* (2013.01); *F28G 1/166* (2013.01); *F28G 15/00* (2013.01); *B25B 9/02* (2013.01)

(58) Field of Classification Search

CPC ..... F22B 37/54; F28G 1/166; F28G 15/00; B60T 17/221; B25B 27/00; B25B 27/0021; B25B 27/0035; B25B 9/02

See application file for complete search history.

(56) References Cited

U.S. PATENT DOCUMENTS

| | | | | | |
|---|---|---|---|---|---|
| 1,544,903 | A * | 7/1925 | Heely | B25B 27/023 | 269/254 CS |
| 2,448,512 | A * | 9/1948 | Brackett | B21D 39/10 | 72/122 |
| 2,890,862 | A * | 6/1959 | Heller | F28G 3/10 | 134/6 |
| 3,214,867 | A * | 11/1965 | Henning | 134/10 | |
| 3,269,659 | A * | 8/1966 | Shelton | F28G 1/163 | 134/167 C |
| 3,835,817 | A * | 9/1974 | Tuomaala | F28G 7/00 | 122/379 |

(Continued)

FOREIGN PATENT DOCUMENTS

| | | |
|---|---|---|
| EP | 2574917 | 4/2013 |
| FR | 1446119 | 7/1966 |

*Primary Examiner* — Monica S Carter
*Assistant Examiner* — Danny Hong
(74) *Attorney, Agent, or Firm* — Vidas, Arrett & Steinkraus, P.A.

(57) ABSTRACT

The boiler cleaning apparatus and method provides for cleaning the exterior surfaces of a heat exchanger. The apparatus and method include tools and steps, respectively, for temporarily spreading tubes and holding open the tubes to gain access to tube lanes. Once access to a lane is attained, a nozzle assembly having an outlet for blowing high velocity cleaning fluid is selected from a group of nozzle assemblies. The selected nozzle assembly will have an outlet for blowing fluid in a direction that effectively cleans the tubes adjacent the opened lane. After the tubes are cleaned the tool for holding the lane opened is removed and the process is repeated for another lane.

16 Claims, 4 Drawing Sheets

(56) References Cited

U.S. PATENT DOCUMENTS

| | | | | | |
|---|---|---|---|---|---|
| 4,095,305 | A * | 6/1978 | Goodwin | F28G 3/10 | 134/167 C |
| 4,283,807 | A * | 8/1981 | Bizard | F28G 1/12 | 15/104.062 |
| 4,344,570 | A * | 8/1982 | Paseman | B05B 3/18 | 118/317 |
| 4,605,028 | A * | 8/1986 | Paseman | B08B 9/0433 | 134/167 C |
| 4,840,145 | A * | 6/1989 | Vollhardt | B08B 7/02 | 122/379 |
| 4,907,542 | A * | 3/1990 | Maeyama | F22B 37/00 | 122/379 |
| 5,315,966 | A * | 5/1994 | Gamache | F28G 7/00 | 122/379 |
| 5,416,946 | A | 5/1995 | Brown et al. | | |
| 8,002,902 | B2 | 8/2011 | Krowech | | |
| 2009/0282631 | A1 | 11/2009 | Krowech | | |

* cited by examiner

TUBE SPREADING DEVICE AND BOILER CLEANING SYSTEM

CROSS-REFERENCE TO RELATED APPLICATIONS

This application claims priority to U.S. Provisional Patent Application Ser. No. 62/068,171, filed Oct. 24, 2014, entitled Tube Spreading Device which is incorporated herein by reference in its entirety.

BACKGROUND OF THE INVENTION

1. Field of the Invention

The present invention generally relates to devices used in the cleaning of heating, ventilation, and air conditioning (HVAC) apparatus, and more specifically, to a boiler cleaning apparatus and method for cleaning the external surfaces of water-tube heat exchangers.

2. Description of the Related Art

The exterior surfaces of heat exchange tubes in a heat recovery steam generator or HRSG are exposed to the byproducts of combusting fuel gases. These byproducts include but are not limited to soot, slag and ash that adhere to the surfaces of the tubes, creating a layer that inhibits the rate of heat transfer between the fluid (water and/or steam) flowing inside the tubes and the combusting gases flowing on the exterior of the tubes. A decrease of heat transfer efficiency demands the burning of more fuel to achieve a desired level of performance, thus diminishing the efficiency of the HRSG, increasing the costs of operation, and increasing emissions. Furthermore, the layer of byproducts may function to cause tube wall degradation leading to premature tube failure, and increased maintenance or replacement expense.

In the past in order to spread tubes of a vertical or horizontal tube bank during cleaning of a boiler apparatus, multiple hydraulic wedges were required to be installed in a sequence, combined with insertion of a blocking medium (typically wood blocks), to keep a temporary cleaning lane open between the tubes, while cleaning activities were performed between the tubes. The depth of penetration into the tube bank was limited to a few of the outer most tube rows, and the effectiveness of cleaning was diminished. Problems associated with the older tube spreading tooling include the flexure of the tines or bare tubes which occurred when attempting to spread apart tubes disposed at a distance away from the hydraulic ram. At some point of tube spreading, a risk is present of excessive flexure of outer rows of tubes when attempting to spread deeper tube rows, which in turn limits the available insertion depth into the tube bank for cleaning activities.

Another problem associated with the older tube spreading tooling is the weight of the tube spreading device, which may act as a limiting factor requiring multiple workers to fully operate the cleaning device.

An additional problem associated with the older tube spreading tooling includes the use of multiple blocks positioned between tubes which have been previously separated, to maintain space for temporary cleaning lanes. The use of multiple blocks consumes valuable space used by cleaning lances and/or cleaning tools or devices during cleaning operations. Cleaning activities in narrow vertical or horizontal lanes between rows of tubes is restricted as a result of the inherent thickness of multiple blocks stacked on top of each other, which in turn decreases the available surface area for cleaning, reducing cleaning effectiveness.

A further problem associated with the older tube spreading tooling is related to safety to service personnel, because the known tube spreading tooling including components such as an hydraulic hand pump, hydraulic wedge, and blocking, to name a few, while being used at heights, and in peculiar spaces proximate to the tubes of the boiler apparatus, proved difficult to safely control when utilizing wedges of increased length or size. For example a hydraulic hand pump used to activate a wedge would be difficult for a person to operate safely while located on temporary scaffolding.

SUMMARY OF THE INVENTION

The boiler cleaning apparatus and method provides for cleaning the exterior surfaces of a heat exchanger. The apparatus and method include tools and steps, respectively, for temporarily spreading tubes and holding open the tubes to form tube lanes. Once access to a lane is attained, a nozzle assembly having an outlet for blowing high velocity cleaning fluid may be selected from a group of nozzle assemblies. The selected nozzle assembly will have an outlet for blowing fluid in a direction that effectively cleans the tubes adjacent the opened lane. After the tubes are cleaned the tool for holding the lane opened is removed and the process is repeated for another lane. Accordingly, the invention presents an apparatus for cleaning boiler tubes that is effective and efficient, while being cost effective to use and maintain, while improving the safety to individual service personnel.

The tube spreading device in some embodiments penetrates into the vertical or horizontal rows of a tube bank an enhanced depth dimension, and requires less time to accomplish penetration and tube spreading, compared to the known tube spreading devices. The amount of flexure on the vertical tubes of the heat exchanger may be controlled/regulated by using fixed width tube spreading devices. The fixed width tube spreading devices, which are sized dependent on the specifications of each job, in some embodiments minimize the risk of exceeding acceptable stress levels on the flexed tubes. Minimizing risks associated with exceeding acceptable stress levels on the flexed tubes reduces the possibility of permanent deformation of the tubes, or causing leaks in the pressure boundary. The tube spreading device is designed for use with one or two man crews, depending on the site specifics, providing more convenient operation characteristics. The tube spreading device additionally improves safety to individuals by providing holes or points to attach "leashes" in order to minimize drop hazards.

The tube spreading devices in some embodiments combine the tube spreading and blocking functions to improve the efficiency of cleaning activities.

The tube spreading device in some embodiments decreases the area occupied by blocking devices and increases the effective area available for cleaning activities.

The tube spreading device in some embodiments facilitates the removal of the tube spreading device from an inserted position between rows of tubes, through the use of a pneumatic hammer.

The tube spreading device in some embodiments eliminates the need to individually use hydraulic spreading heads to remove each individual block which is used to maintain tube lanes, improving the efficiency of cleaning activities.

In some embodiments, the tube spreading device reduces the weight of tube cleaning equipment which in turn diminishes the rate of worker fatigue.

In some embodiments, the tube spreading device utilizes a pneumatic hammer to insert and remove the tube spreading device from a tube bank as opposed to manually pumping a hydraulic wedge.

In some embodiments the tube spreading device incorporates anchor points for "leashes" or other attachments to minimize accidental tool droppings.

In some embodiments the use of a tube spreading device having a fixed width will greatly decrease the risk of over stressing a component such as a tube, joint, pressure part, or heat transfer surface.

The tube spreading device in some embodiments uses an air compressor which may be on-site for the cleaning activities, to supply the energy needed for the tube spreading operations. The air compressor may discharge air at a high pressure, high volume rate. The pneumatic hammer may use low pressure (90 PSI) and thus may use a regulator and lubricating element. A pressure gauge located near the inlet to the hammer may be used to adjust the upstream regulator pressure to approximately 90 PSI, to operate the hammer at peak efficiency. Higher or lower operation pressure settings may alternatively be utilized dependent on the manufacturer and age of the hammer, and to satisfy specific site requirements.

Applicant incorporates herein by reference U.S. Pat. No. 8,002,902, in its entirety.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
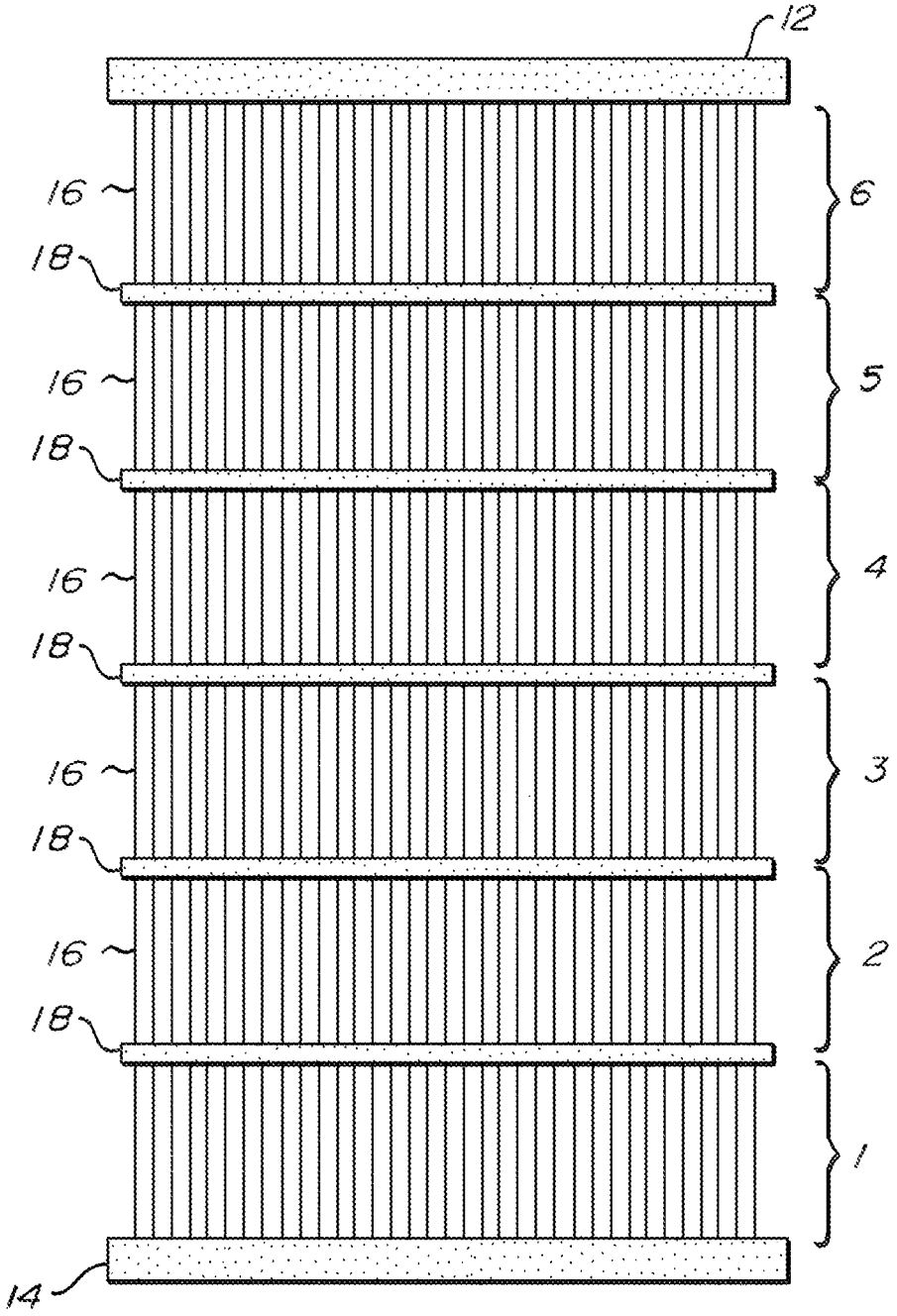
FIG. 1 is a plan view of a typical tube regenerator panel to be cleaned by a boiler cleaning apparatus according to the present invention.

Attention is first directed to FIG. 1, which illustrates a typical panel commonly found within a heat recovery steam generator or HRSG. The typical panel comprises respective upper and lower headers 12, 14, finned or bare water tubes 16, and tube ties 18. Smaller areas or levels (1-6) between the tube ties are focused on during the cleaning process.

Figure 3:
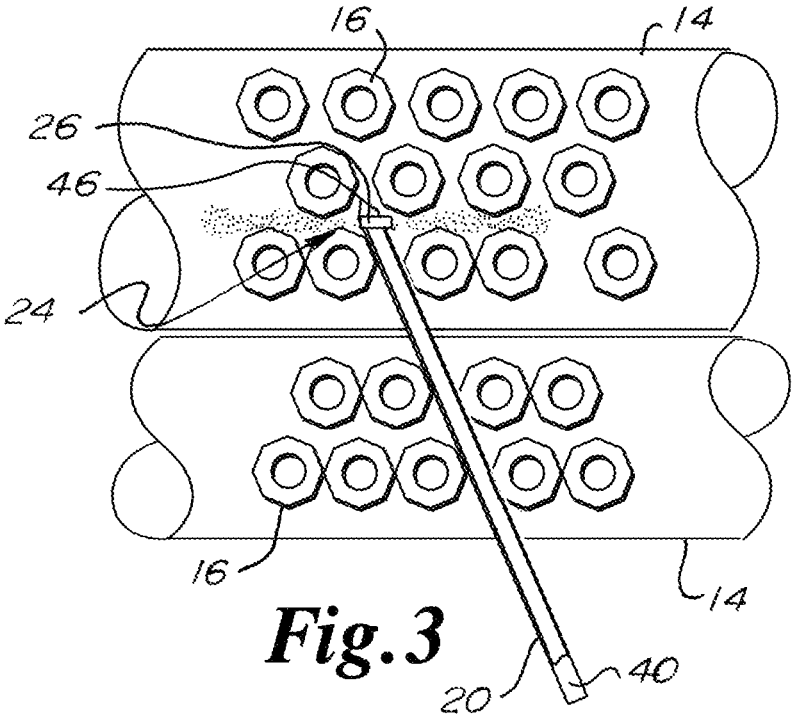
FIG. 3 is a perspective view of one embodiment showing the use of a spray nozzle in cleaning of a tube bank of a water tube section of a boiler according to the present invention.

A side blow nozzle assembly is shown in FIG. 3. Side blow nozzle assembly comprises an elongate nozzle pipe 20 having a cleaning fluid entry end and spraying end 24. A pipe 26 having diametrically opposed openings defines the spraying end 24. Pipe 26 is perpendicular to nozzle pipe 20.

An angled side blow nozzle assembly may alternatively be utilized which is similar to the nozzle assembly described immediately above, except that the pipe 26 disposed at an acute angle of approximately sixty degrees with nozzle pipe 20. The length of the nozzle pipe and the dimensions of the fluid flow paths and spray outlets in all of the nozzle assembly embodiments are determined according to the design and dimensions of the heat exchange panel to be cleaned.

Figure 2:
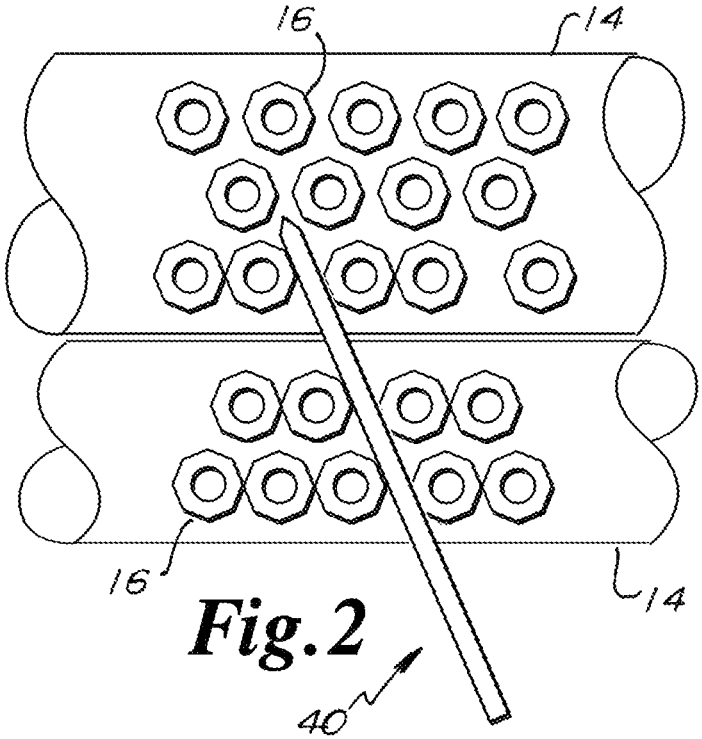
FIG. 2 is perspective view showing one embodiment where an alignment bar is utilized in boiler cleaning activities to clean tubes of a water tube section according to the present invention.

FIG. 2 shows spreader bar 40 inserted between tubes 16 of a tube bank to separate adjacent tubes 16 to form a temporary cleaning lane. Nozzle pipe 20 may then be inserted above or below spreader bar 40 in the temporary cleaning lane to engage in tube cleaning activities of a boiler. (FIG. 3)

FIGS. 4 through 8 illustrate unique tools which may be utilized to spread the tubes of a tube panel to gain access to the inner tubes for cleaning.

Attention is now directed to FIGS. 4 through 8, which illustrate the use of the above-described apparatus when cleaning the boiler tubes 16. The initial cleaning step, involves cleaning the tube faces on the outer row of the panel. Note that for effective cleaning, the blast cleaning spray from the nozzles is applied diagonally to the tubes 16 along diagonal lanes between the tubes. During temporary cleaning activities a spreader bar 40 is used to spread any desired number of rows of tubes 16 to form a lane of a desired width. In at least one embodiment, one size of spreader bar 40 is driven into the tube bank or panel to create a uniform sized lane to increase the speed of the cleaning process. In some embodiments, two different sizes of spreader bars 40 may be used within one temporarily opened cleaning lane. In this embodiment, where the two spreader bars 40 insertion process is utilized, the thinner of the two spreader bars 40 will be inserted deeper into the tube bank or be placed above the larger spreader bar 40 so that the smaller spreader bar 40 will not fall out during the cleaning process. The larger spreader bar 40 will remove the clamping force of the tubes 16 against the smaller spreader bar 40 which would cause it to become unstable for work purposes.

The lane being held open by the fixed width dimension for the spreader bar 40 permits access into a tube panel for use of a desired nozzle assembly.

Figure 7:
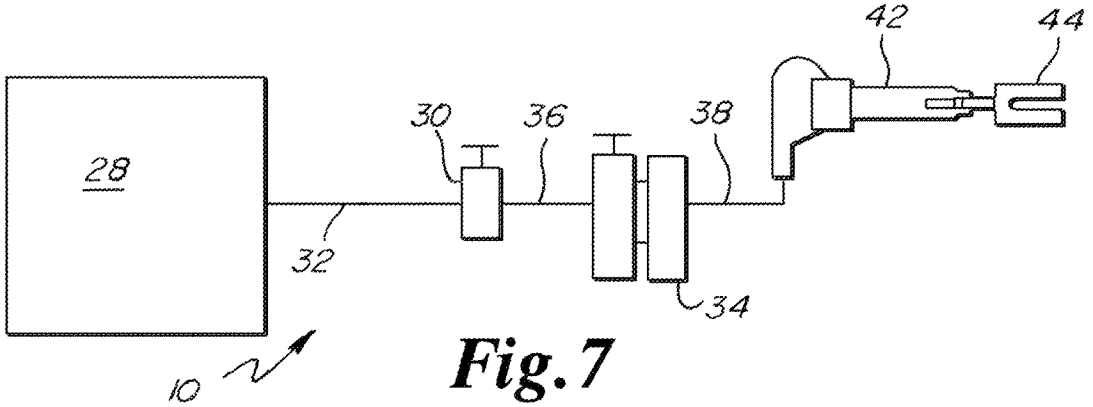
FIG. 7 is a block diagram of one alternative embodiment of the system used to spread the rows of vertical or horizontal tubes of a tube bank of a heat recovery steam generator boiler system.

FIG. 7 is a block diagram of one alternative embodiment of the system and devices used to spread the rows of vertical or horizontal tubes 16 of a tube bank of a heat recovery steam generator boiler system 10.

Referring to FIGS. 4 through 8, boiler cleaning system 10 may generally include a pneumatic source/air compressor 28 which is generally present on-site during boiler cleaning activities. Air compressor 28 may generally output pressurized air not to exceed approximately 450 pounds per square inch gauge or PSIG. Larger or smaller pressures may alternatively be utilized.

In some embodiments the compressor 28 is coupled to a pressure regulator 30 by pipes/hoses 32 which include the appropriate fittings. Pipes/hoses 32 should have a pressure rating of up to approximately 500 PSIG. Larger or smaller pressure ratings and pressures may alternatively be utilized.

In some embodiments, pressure regulator 30 is used to regulate pressure in boiler cleaning system 10 to a maximum outlet pressure of approximately 90 PSIG for an inlet having dimensions of approximately ¼ inch. In alternative embodiments, larger or smaller PSIG values may be utilized. In at least one embodiment the pressure regulator 30 may be a Swaglok® pressure regulator.

In some embodiments, pipes/hoses 36 connect pressure regulator 30 to a regulator/filter and lubricator unit 34. In at least one embodiment, the regulator/filter and lubricator unit 34 may be available from Ingersol Rand® having a ½ inch inlet and outlet. The pipes/hoses 36 include appropriate fittings where the pipes/hoses 36 and fittings are rated up to approximately 200 PSIG. In alternative embodiments, the size for the pipes and/or fittings may be increased or decreased and the PSIG value may be increased or decreased at the discretion of a user dependent on site requirements.

In at least one embodiment, hose 38 including appropriate fittings is in communication with and connects a pneumatic hammer 42 to regulator/filter and lubricator unit 34. The hose 38 in at least one embodiment is rated up to approximately 200 PSIG. In alternative embodiments, larger or smaller PSIG values may be utilized. In at least one embodiment the pneumatic hammer 42 may be obtained from Ingersol Rand®.

In at least one embodiment a driver 44 is engaged to the pneumatic hammer 42.

In some embodiments, the devices used to spread rows of vertical tubes or horizontal tubes 16 of a tube bank of a heat recovery steam generator boiler system 10 include the use of a spreader bar 40. In some embodiments, spreader bar 40 is generally formed of sturdy metallic material having a fixed width dimension, and is in a rectangular tubular configuration. In alternative embodiments the spreader bar 40 may be formed of solid metal or other materials which will not fracture or fail during use in tube spreading and cleaning activities.

In some embodiments, the spreader bar 40 has a length dimension of approximately 2 feet to 4 feet. In alternative embodiments, the spreader bar 40 may be longer than 4 feet and shorter than 2 feet.

In some embodiments the spreader bar 40 has a fixed width dimension of approximately 3/16 of an inch to 1 inch. In alternative embodiments the spreader bar 40 may have a width dimension smaller than 3/16 inch and larger than 1 inch.

In some embodiments, the spreader bar 40 has a height dimension of approximately 1 3/16 inches to 2 inches. In alternative embodiments the spreader bar 40 may have a height dimension less than 1 3/16 inch and larger than 2 inches.

In some alternative embodiments, the spreader bar 40 is formed of steel, stainless steel, carbon steel, iron, or other metallic materials which are resistant to fracture, fail, breaking, or bending when exposed to impact or forces such as pounding or hammering from a pneumatic hammer 42.

In some embodiments, the spreader bar 40 includes a fixed width spreading section 45 and a tapered end 46. The tapered end 46 in some embodiments may be formed by cutting a rectangular shaped cutout from the end of the spreader bar 40. The rectangular shaped cutout may be removed from the top and bottom of the end of the spreader bar 40 forming a first plate section 48 and a second plate section 50. In some embodiments, the first and second plate sections 48, 50 may then be compressed together to form a vertical insertion edge 52. In some embodiments the first and second plate sections 48, 50 may be welded together along the insertion edge 52. In some embodiments, the cutting, bending and welding process will leave an opening in the top and bottom of the tapered end 46 of the spreader bar 40.

In some embodiments, a triangular shaped upper plate 54 will be welded to the top edge of each of the first plate section 48 and the second plate section 50 to close the opening in the top of the tapered end 46. In some embodiments, a triangular shaped lower plate 56 will be welded to the bottom edge of each of the first plate section 48 and second plate section 50 to close the opening in the bottom of the tapered and 46. In some embodiments, the rearward edge of the upper plate 54 will be welded across the top width of the tapered end 46 establishing an upper notch 58. In some embodiments, the rearward edge of the lower plate with 56 will be welded across the bottom width of the tapered end 46 to establish a lower notch 60.

In some embodiments, the upper plate 54 and the lower plate 56 have a thickness dimension of approximately 3/16 inch. In alternative embodiments, the thickness dimension for the upper plate 54 and lower plate 56 may be larger or smaller than 3/16 inch.

In some embodiments the first plate section 48 and the second plate section 50 have a length dimension of approximately 4 inches. In alternative embodiments, the first plate section 48 and the second plate section 50 have a length dimension larger or smaller than 4 inches.

In some embodiments the height of the insertion edge 52 is approximately 2 inches. In alternative embodiments the height dimension for the insertion edge 52 may be larger or smaller than 2 inches.

In some alternative embodiments, the insertion edge 52, as welded together is inserted between tubes 16 of a tube bank to separate the tubes 16 to form a tube lane to facilitate cleaning activities.

In some embodiments, the tapered end 46 is formed in the shape of a wedge. In alternative embodiments, other manufacturing methods may be implemented to form the tapered end 46 for insertion between tubes 16 of the tube bank.

In some embodiments, the spreader bar 40 includes a working end 62. Working end 62 is generally open prior to manufacturing. Working end 62 in some embodiments receives and L-shaped driving bar 64. In alternative embodiments, working end 62 receives a driving element 66.

In some embodiments, either the L-shaped driving bar 64 or the driving element 66 is inserted into the open end of the working end 62. The L-shaped driving bar 64 and/or the driving element 66 may be welded to the working end 62 by a plug weld and by welding about the rectangular tubular circumference at the interface of the L-shaped driving bar 64 and/or driving element 66 with the interior edge of the working end 62.

In some embodiments, the L-shaped driving bar 64 and/or driving element 66 are inserted within the interior of the working end 62. In other embodiments, the L-shaped driving bar 64 and/or driving element 66 are disposed over the exterior of the working end 62. In some embodiments, the L-shaped driving bar 64 and/or driving element 66 are securely affixed to the working end 62 and do not separate, fracture or fail when the L-shaped driving bar 64 and/or driving element 66 are exposed to impact or pounding forces from a pneumatic hammer 42.

In some embodiments, the working end 62 includes a safety aperture 70. Safety aperture 70 in some embodiments may receive a safety rope, cord, strap or cable to minimize risk of dropping of the spreader bar 40, other tools, or from causing injury to individuals during tube spreading and cleaning activities.

Any number of alignment bars 40, having different lengths and different width dimensions may be inserted into a tube bank during tube spreading and tube cleaning activities. In at least one embodiment approximately fifteen spreader bars 40 may be inserted into a tube bank during tube cleaning activities.

In some embodiments, the L-shaped driving bar 64 is substantially rectangular in shape having a tubular interface section 72 for insertion within the interior of the working end 62 or for positioning over the exterior of the working end 62. In some embodiments, the L-shaped driving bar 64 includes a vertical drive block 74 which extends upwardly from the tubular interface section 72. In some embodiments, the vertical driving block 74 is welded to the tubular interface section 72. In other embodiments, the vertical drive block 74 includes the tubular interface section 72 as a cohesive unit of the L-shaped driving bar 64. In some embodiments the tubular interface section 72 is formed of solid metallic material.

In some embodiments, the L-shaped driving bar 64 is formed of the same or different materials as identified previously for the spreader bar 40.

In some embodiments, the vertical drive block 74 has a height dimension of approximately 6 inches. In other embodiments, the height dimension for the vertical drive block 74 may be larger or smaller than 6 inches.

In some embodiments, the width dimension of the vertical drive block 74 is approximately 3 inches. In other embodiments, the width dimension of the vertical drive block 74 may be larger or smaller than 3 inches.

In at least one embodiment, the thickness dimension of the vertical drive block 74 is approximately 1 inch. In other embodiments, the thickness dimension for the vertical drive block 74 may be larger or smaller than 1 inch.

In at least one embodiment, a driving rod 76 extends horizontally outwardly from each opposite side of the vertical drive block 74. In some embodiments the driving rod 76 is located proximate to the bottom of the vertical drive block 74 and is at a height which is aligned with a central longitudinal axis for the spreader bar 40.

In some embodiments, the driving rod 76 is a single piece and traverses the vertical drive block 74 through an aperture. In an alternative embodiment, the driving rod 76 is split into two sections where each section extends horizontally outwardly from opposite sides of the vertical drive block 74. In some embodiments, the driving rod 76 is welded to the vertical drive block 74 proximate to each opposite exterior side surfaces. The driving rod 76 in some embodiments is formed of the same or different materials as selected for the L-shaped driving bar 64 and/or the spreader bar 40 and will not separate, fracture, or fail when the driving rod 76 is exposed to impact or pounding forces from a pneumatic hammer 42.

In at least one embodiment, the driving rod 76 has a length dimension of approximately 6½ inches. In other embodiments, the length dimension for the driving rod 76 may be larger or smaller than 6½ inches.

In some embodiments, the driving rod 76 is cylindrical in shape having a diameter dimension of approximately ¾ inch. In other embodiments, the diameter dimension for the driving rod 76 may be larger or smaller than ¾ inch.

In at least one embodiment, the driving rod 76 includes a first end 78 and a second end 80. In some embodiments, a positioning stop 82 is secured to the driving rod 76 proximate to each of the first end 78 and second end 80. In some embodiments the positioning stops 82 may be a large washer which is welded to the first end 78 and second end 80 of the driving rod 76.

In some embodiments, a bolt head and/or nut may be disposed and/or integral to the driving rod 76 proximate to the first end 78 and/or second end 80 exterior to the positioning stops 82.

In some embodiments, the driving element 66 is substantially rectangular in shape having a tubular interface section 72 as earlier described for insertion within the interior of the working end 62, or for positioning over the exterior of the working end 62. In at least one embodiment the driving element 66 includes a drive plate surface 84 which is opposite to the tubular interface section 72. In some embodiments the drive plate surface 84 is integral with the tubular interface section 72 and in other embodiments the drive plate surface 84 is welded to the end of the driving element 66 opposite to the tubular interface section 72.

In at least one embodiment a driving element 66 is formed of the same or different materials as identified for the spreader bar 40 and/or L-shaped driving bar 64 and will not separate, fracture or fail when exposed to impact or pounding forces from a pneumatic hammer 42 or sledgehammer.

In at least one embodiment, the driving element 66 has a chamfered edges to facilitate coupling with the working end 62 of the spreader bar 40.

In at least one alternative embodiment, the driving element 66 has a length dimension of approximately 4 inches. In other embodiments, the driving element 66 has a length dimension larger or smaller than 4 inches.

In some embodiments, a driving rod 76 extends horizontally outwardly from each opposite side of the driving element 66 as earlier described relative to the vertical drive block 74. In some embodiments, the driving rod 76 is aligned with a central longitudinal axis for the driving element 66 and the spreader bar 40.

In at least one alternative embodiment the driving rod 76 is a single piece and traverses the driving element 66 through an opening. In an alternative embodiment, the driving rod 76 is split into two sections, where each section extends horizontally outwardly from opposite sides of the driving element 66. In some embodiments the driving rod 76 is welded to the driving element 66 proximate to each opposite exterior side surfaces.

In some embodiments, either of the L-shaped driving bar 64 or the driving element 66 are exposed to insertion or extraction drive forces from a pneumatic hammer 42 or sledgehammer. In at least one alternative embodiment the insertion or extraction forces are transferred from the pneumatic hammer 42 to the L-shaped driving bar 64 or driving element 66 through the use of a driver 44.

In some embodiments, the driving rod 76 may be replaced by another mechanical element such as a bolt and nut, a protruding bar, an extension member, or other extension or protrusion, so long as the element utilized in substitution for the driving rod 76 engages the driver 44 to facilitate insertion of the spreader bar 40 between tubes 16 of a tube bank during cleaning activities. The element of the driving rod 76 should be considered to be sufficiently broad to encompass alternative mechanical elements.

In at least one embodiment, the driver 44 includes a base 86. Base 86 receives and supports the bottom of the L-shaped driving bar 64, the bottom of the driving element 66, and/or a portion of the bottom of the spreader bar 40 proximate to the working end 62. In some embodiments, the base 86 defines an internal channel width dimension of approximately 1⅝ inches. In some embodiments the internal channel width dimension for the base 86 may be larger or smaller than 1⅝ inches dependent upon the width dimension selected for the L-shaped driving bar 64, driving element 66, and/or spreader bar 40.

In some embodiments, the base 86 has a length dimension of approximately 4½ inches. In alternative embodiments, the length dimension for the base 86 may be longer or smaller than 4½ inches. In some embodiments, the base 86 may be a single component U-shaped member including opposite vertical positioning members. Alternatively, the base may be a plate welded to the opposite vertical positioning members.

In some embodiments, the interface portion of the driver 44 which is constructed and arranged to interface with the working end 62 of the spreader bar 40, has a height dimension of approximately 3 inches. The height dimension for the interface portion of the driver 44 in some embodiments may be larger or smaller than 3 inches.

In some embodiments, the interface portion of the driver 44 used to couple with the working end 62 includes a first vertical transition member 88 and a second vertical transition member 90. The first and second vertical transition members 88, 90 extend vertically upward from opposite sides of the rearward or distal end of the base 86.

In some embodiments a first horizontal positioning member 92 extends horizontally forwardly from the top of the first vertical transition member 88. In some embodiments, a second horizontal positioning member 94 extends horizontally forwardly from the top of the second vertical transition member 90.

In some embodiments, a first receiving channel 96 is located between the first horizontal positioning member 92 and the first side of the base 86. In some embodiments a second receiving channel 98 is located between the second horizontal positioning member 94 and the second side of the base 86. In some embodiments, the first receiving channel 96 and the second receiving channel 98 are constructed and arranged to releasably receive the driving rod 76 of the spreader bar 40. In some embodiments the first receiving channel 96 and second receiving channel 98 are larger than the diameter or other dimension utilized for the driving rod 76.

In some embodiments, a drive block passage 100 is established between the first horizontal positioning member 92 and the second horizontal positioning member 94 along the top of the driver 44. In some embodiments, during the insertion of the first side of the drive rod 76 in the first receiving channel 96 and the second side of the drive rod 76 in the second receiving channel 98, the drive block 74 is being inserted into the drive block passage 100, where the driving rod 76 and the drive block passage 100 are positioned toward a back plate 102 of driver 44.

In some embodiments, the base 86, first horizontal positioning member 92 and second horizontal positioning member 94 extend horizontally outwardly and forwardly from the back plate 102.

It should be noted that in some embodiments that the base 86 may be replaced by third and fourth positioning members at the discretion of an individual.

In some embodiments, the base 86, the first horizontal positioning member 92 and second horizontal positioning member 94 are welded to the back plate 102, which functions as a positioning stop for the vertical drive block 74 within the drive block passage 100, or as a positioning stop for the drive plate surface 84 within the interior of the driver 44.

In some embodiments the driver 44 is formed of the same or different metallic materials as utilized in the spreader bar 40. In some embodiments the welding of the base 86, first horizontal positioning member 92, and/or second horizontal positioning member 94 to the back plate 102 will not separate, fracture or fail when exposed to impact or pounding forces from a pneumatic hammer 42 or sledgehammer.

In at least one alternative embodiment a chisel 104 is welded to the back or opposite side of the back plate 102 relative to the base 86 and first and second horizontal positioning members 92, 94. In some embodiments the distal end of chisel 104 includes a collar 106 and a hammer adapter 108 extends outwardly from the collar 106 for releasable engagement to a pneumatic hammer 42.

In some embodiments the chisel 104, collar 106, and hammer adapter 108 are formed of sturdy metallic materials as earlier described which will not separate, fracture or fail when exposed to impact or pounding forces from the pneumatic hammer 42. In some embodiments, the hammer adapter 108 and chisel 104 are used to impart impact forces on the back plate 102 for transfer through the driver 44 onto the driving rod 76 to insert the tapered end 46 of the spreader bar 40 between tubes 16 of a tube bank to establish a tube lane for cleaning activities.

Figures 4, 5, 8:
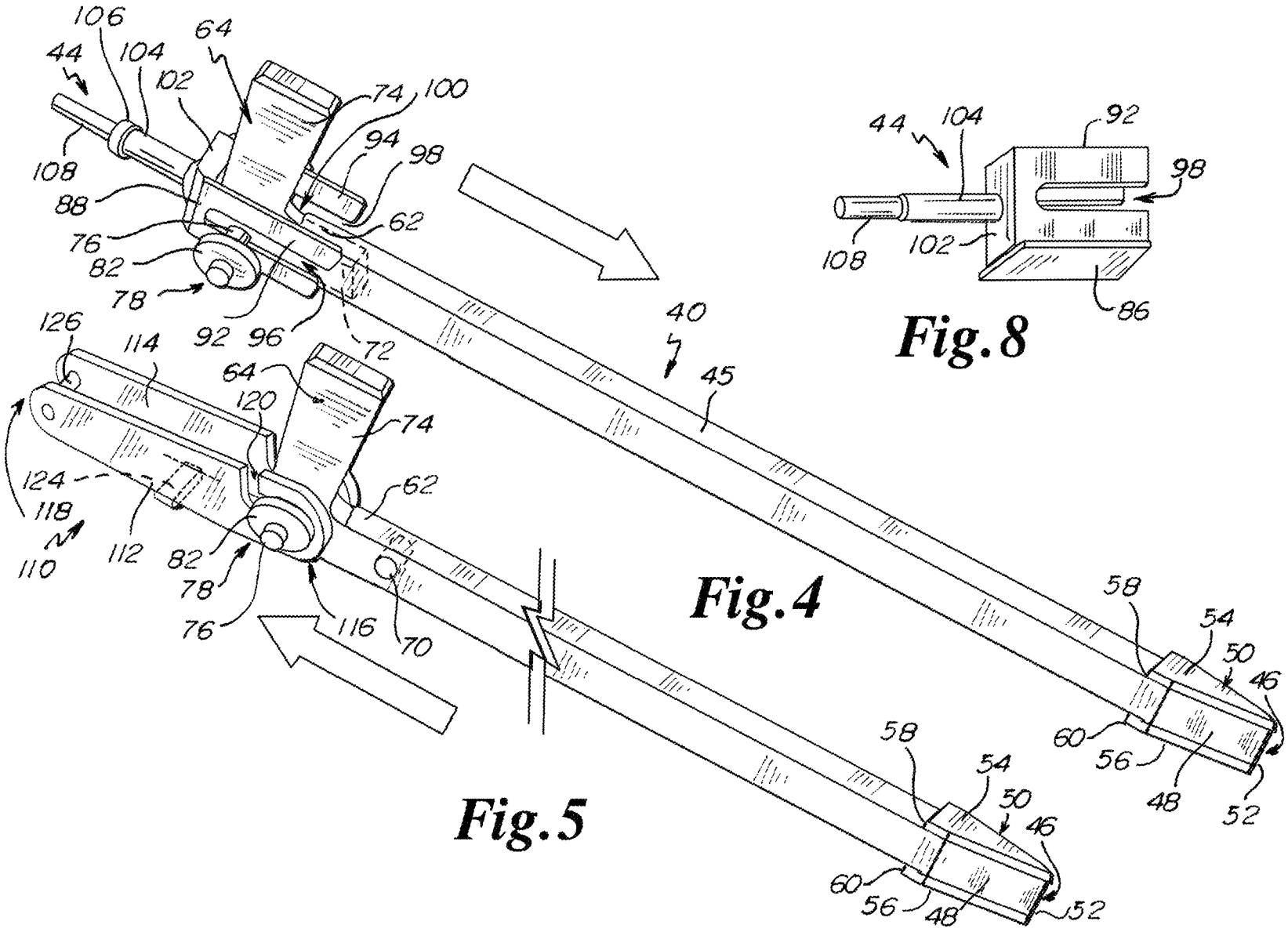
FIG. 4 is a detail isometric view of one alternative embodiment of an alignment bar and driver for insertion into a tube bank.
FIG. 5 is a detail isometric view of one alternative embodiment of an alignment bar and extraction device for removal of the alignment bar from a tube bank.
FIG. 8 is a isometric view of one embodiment of a driver of the present invention.
Figure 6:
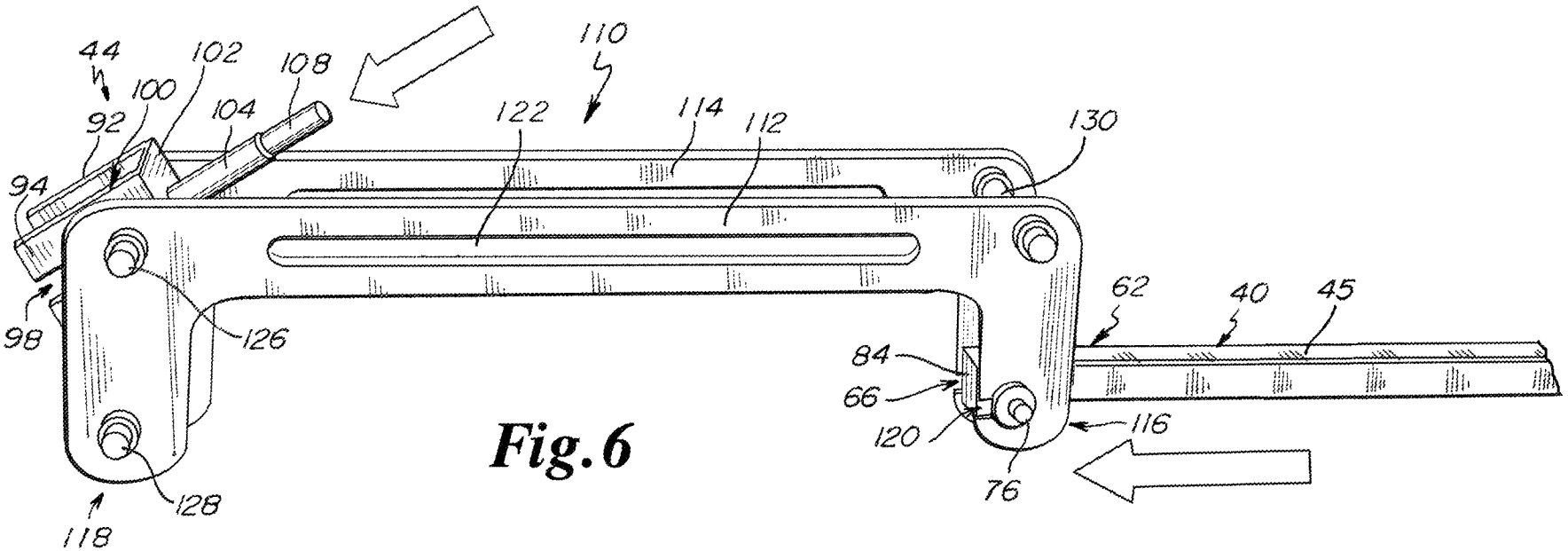
FIG. 6 is a detail isometric view of one alternative embodiment of an alignment bar, extraction device, and driver for removal of the alignment bar from a tube bank.

In some embodiments, the boiler cleaning system 10 includes an extraction device generally referred to by reference numeral 110. The extraction device 110 in some embodiments is coupled to the driving rod 76 to impart forces to withdraw a previously inserted spreader bar 40 from a tube bank. (FIGS. 5 and 6)

In some embodiments the extraction device 110 is formed of a first support member 112 and a second support member 114. Each of the first and second support member's 112, 114 include a first end 116 and a second end 118. Each of the first and second ends 116, 118 may be rounded in some embodiments.

In some embodiments, each of the first and second support members 112, 114 include a receiving slot 120. In some embodiments the receiving slot 120 includes a vertical portion and a horizontal portion creating a hook shape for each of the first ends 116 of the first and second support members 112, 114 respectively. In some embodiments the receiving slots 120 engage the first and second ends 78, 80 of the driving rod 76, where the hook shaped first ends 116 of the first and second support members 112 114 prevent inadvertent separation of the extraction device 110 from the spreader bar 40 during the removal of the spreader bar 40 from a tube bank.

In some embodiments, the hook shaped first end 116 of the first support member 112 is disposed between a positioning stop 82 of the first end 78 and the drive block 74 or tubular interface section 72, capturing the first end 78 of the driving rod 76. In some embodiments the hook shaped end 116 of the second support member 114 is disposed between a positioning stop 82 of the second end 80 and the opposite side of the drive block 74 or tubular interface section 72, capturing the second end 80 of the driving rod 76.

In some embodiments each of the first and second support member's 112, 114 includes an open area 122 which facilitates handling by an individual and reducing the weight of the first and second support member 112, 114. A first or second support member 112, 114 is not required to include an open area 122. In some embodiments the inclusion of an open area 122 in either the first or second support members 112, 114 does not adversely affect the structural integrity of the extraction device 110.

In some embodiments, the first support member 112 is securely connected to the second support member 114 through the use of a support bar 124 which may be welded to the bottom edge of the first and second support members 112, 114. The first and second support members 112, 114 are substantially aligned and are parallel relative to each other. In some embodiments, the first support member 112 may be separated from the second support member 114 by a dimension of approximately 2¾ inches. In an alternative embodiment the separation distance between the first support member 112 and the second support member 114 may be larger or smaller than 2¾ inches.

In some embodiments, the support bar 124 may have dimensions of approximately 4 inches in length, 1 inch in width, and ⅜ inch in thickness. The dimensions for the support bar 124 may be increased or decreased at the discretion of an individual.

In some embodiments, the second ends 118 of the first support member 112 and the second support member 114 are engaged to each other by an extraction rod 126 which may be welded to each of the first and second support members 112, 114 traversing therebetween. In some embodiments the second ends 118 of the first and second support members 112 114 each include a receiving hole, and the extraction rod 126 passes through each receiving hole for welding thereto. In some embodiments the terminal ends of the extraction rod 126 are disposed to the exterior of each of the first and second support members 112, 114 and include a stop such as a bolt head and/or nut, which in turn may be welded to the exterior surface of the respective first or second support members 112, 114.

In some embodiments the extraction rod 126 receives the first and second receiving channels 96, 98 of the driver 44 when the pneumatic hammer 42 is positioned to provide impact forces away from a tube bank to remove the spreader bar 40 from the tube bank. (FIG. 6) In some embodiments the extraction device 110 is engaged to and positioned between each of the working end 62 of the spreader bar 40, and the driver 44 and pneumatic hammer 42, which are engaged to the extraction device 110 opposite to the working end 62 to remove the spreader bar 40 from an engaged position within a tube bank.

In some embodiments, when the extraction device 110 is in an operative position relative to the spreader bar 40, the impact force applied to the extraction rod 126 in a direction away from a tube bank is transferred to the hook shaped first ends 116 to draw the driving rod 76 and the spreader bar 40 away from the tube bank to separate the spreader bar 40 from the tube bank.

In some embodiments, the extraction device 110 is formed of the same or different sturdy metallic materials as earlier described relative to the spreader bar 40 and driver 44 and will not separate, fracture, or fail when exposed to impact or pounding forces from the pneumatic hammer 42.

In some embodiments, the first and second support members 112, 114 have a length dimension of between approximately 1 foot and 3⅝ inches to 2 feet 3⅝ inches. In alternative embodiments the length dimension of the first and second support members 112, 114 may be shorter than one 13⅝ inches and longer than 2 feet 3⅝ inches.

In some embodiments the first and second support members 112, 114 are separated from each other by a dimension of approximately 2¾ inches. In alternative embodiments the separation distance between the first and second support members 112, 114 may be larger or smaller than 2¾ inches.

In some embodiments the first and second support members 112, 114 have a varying height dimension between the first end 116 and the second end 118 which may be between 8 inches and 2 inches. In some embodiments, the height dimension for the first and second support members 112, 114 may be smaller than 2 inches and larger than 8 inches.

In some embodiments, the first and second support member's 112, 114 have a thickness dimension of approximately ⅜ inch. In some embodiments the thickness dimension for the first and second support members 112, 114 may be larger or smaller than ⅜ inch.

In an alternative embodiment, the extraction device 110 may be substantially U-shaped, where each of the first and second support member's 112, 114 have an elongated height dimension. In some embodiments, the support bar 124 has been omitted and replaced with a second extraction rod 128 and third extraction rod 130. In some embodiments the extraction rod 126, second extraction rod 128 and/or third extraction rod 130 traverse the space between the first and second support members 112, 114. In some embodiments the extraction rod 126, and second and third extraction rods 128, 130 are welded to the interior or exterior of a respective first or second support member 112, 114.

In some embodiments, the receiving slot 120 does not include a vertical section and is disposed horizontally to form the hook shaped first end 116.

In some embodiments, the first receiving channel 96 and second receiving channel 98 of the driver 44 may be engaged to any one of the extraction rod 126, second extraction rod 128, or third extraction rod 130 where the pneumatic hammer 42 is positioned to impart impact forces away from a tube bank, through the hook shaped first ends 116, and through the driving rod 76 to withdraw the spreader bar 40 from an engaged position within a tube bank.

In some alternative embodiments, the height dimension for the first and second support members 112, 114 is approximately 9½ inches. In alternative embodiments, the height dimension for the first and second support members 112, 114 may be larger or smaller than 9½ inches.

In some alternative embodiments, the remaining functions and features of the extraction device 110, second extraction rod 128 and third extraction rod 130 are substantially identical to the extraction rod 126 as earlier described.

In some embodiments the remaining functions and features of the first and second support members 112, 114 are substantially identical between embodiments having an increased height dimension for the first and second support members 112, 114.

The above examples and disclosure are intended to be illustrative and not exhaustive. These examples and description will suggest many variations and alternatives to one of ordinary skill in this art. Further, the particular features presented in the dependent claims can be combined with each other in other manners within the scope of the invention such that the invention should be recognized as also specifically directed to other embodiments having any other possible combination of the features of the dependent claims.

In addition to being directed to the embodiments described above and claimed below, the present invention is further directed to embodiments having different combinations of the features described above and claimed below. As such, the invention is also directed to other embodiments having any other possible combination of the dependent features claimed below.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

This completes the description of the preferred and alternate embodiments of the invention. Those skilled in the art may recognize other equivalents to the specific embodiment described herein which equivalents are intended to be encompassed by the claims attached hereto.

We claim:

1. A tube spreading device comprising:

a spreader bar comprising a tapered end, a spreading section, and a working end, said working end comprising a driving rod, said driving rod extending outwardly from said working end, said driving rod having a first side and a second side; and a driver constructed and arranged for releasable coupling to said driving rod, said driver comprising a top, a first receiving channel and a second receiving channel, said first receiving channel releasably engaging said first side and said second receiving channel releasably engaging said second side, said driver having a drive block passage through said top between said first receiving channel and said second receiving channel, said driver having a back plate, said driver further comprising a hammer adaptor, said hammer adaptor being constructed and arranged for engagement to a pneumatic hammer, wherein said spreader bar has a first insertion and engaged position with said driver when said pneumatic hammer exerts force on said driver and said driving rod, said first side extending through and to the exterior of said first receiving channel and said second side extending through and to the exterior of said second receiving channel during insertion of said tapered end between adjacent tubes of a tube bank and said spreading section engages and separates adjacent tubes of said tube bank;

wherein said spreader bar has a second retraction position where said pneumatic hammer exerts force on said driver to remove said tapered end from positioning between adjacent tubes of said tube bank and said spreading section from engagement with adjacent tubes of said tube bank; and further wherein said driver is physically and spatially separated from contact with said spreader bar upon disengagement of said tapered end from adjacent tubes of said tube bank.

2. The tube spreading device according to claim 1, further comprising an extraction device disposed between said spreader bar and said driver, said extraction device comprising a first support member and a second support member, each of said first support member and said second support member having a first end having a receiving slot, each of said first support member and said second support member having a second end, said extraction device further comprising an extraction rod extending between said first support member and said second support member proximate to said second end, said receiving slot being releasably engaged to said driving rod and said extraction rod being releasably engaged to said receiving channel.

3. The tube spreading device according to claim 2, said driver further comprising a base, a first horizontal positioning member, a second horizontal positioning member, said drive block passage being disposed between said first horizontal positioning member and said second horizontal positioning member.

4. The tube spreading device according to claim 3, said base comprising a u-shaped channel.

5. The tube spreading device according to claim 4, said driver further comprising a chisel.

6. The tube spreading device according to claim 3, further comprising an L-shaped driving bar comprising a tubular interface section, said tubular interface section being constructed and arranged for engagement to said working end.

7. The tube spreading device according to claim 6, said L-shaped driving bar further comprising a vertical drive block, said driving rod being engaged to said vertical drive block, said vertical drive block being releasably disposed in said drive block passage.

8. The tube spreading device according to claim 7, said driving rod comprising opposite ends, each of said opposite ends comprising a positioning stop.

9. The tube spreading device according to claim 3, further comprising a driving element comprising a tubular interface section, said tubular interface section being constructed and arranged for engagement to said working end.

10. The tube spreading device according to claim 9, said driving rod being engaged to said driving element.

11. The tube spreading device according to claim 10, said driving element comprising a drive plate surface.

12. The tube spreading device according to claim 11, said driving rod comprising opposite ends, each of said opposite ends comprising a positioning stop.

13. The tube spreading device according to claim 2, said extraction device further comprising a support bar engaged to and extending between said first support member and said second support member.

14. The tube spreading device according to claim 2, said extraction device further comprising a second extraction rod.

15. The tube spreading device according to claim 14, said extraction device further comprising a third extraction rod.

16. The tube spreading device according to claim 1, further comprising:

an extraction device disposed between said spreader bar and said driver, said extraction device having at least one support member, said at least one support member having a first end having a receiving slot, said at least one support member having a second end, said extraction device further having an extraction rod proximate to said second end, said receiving slot being releasably engaged to said driving rod and said extraction rod being releasably engaged to said first receiving channel and said second receiving channel.

* * * * *